US011180857B2

(12) United States Patent
Wada et al.

(10) Patent No.: US 11,180,857 B2
(45) Date of Patent: Nov. 23, 2021

(54) METHOD FOR PRODUCING POROUS MEMBER

(71) Applicants: TOHOKU TECHNO ARCH CO., LTD., Sendai (JP); TPR CO., LTD., Tokyo (JP)

(72) Inventors: Takeshi Wada, Sendai (JP); Hidemi Kato, Sendai (JP)

(73) Assignees: TOHOKU TECHNO ARCH CO., LTD., Sendai (JP); TPR CO., LTD., Yamagata (JP)

( * ) Notice: Subject to any disclaimer, the term of this patent is extended or adjusted under 35 U.S.C. 154(b) by 511 days.

(21) Appl. No.: 16/077,569

(22) PCT Filed: Jan. 16, 2017

(86) PCT No.: PCT/JP2017/001154
§ 371 (c)(1),
(2) Date: Aug. 13, 2018

(87) PCT Pub. No.: WO2017/141598
PCT Pub. Date: Aug. 24, 2017

(65) Prior Publication Data

US 2019/0093238 A1 Mar. 28, 2019

(30) Foreign Application Priority Data

Feb. 16, 2016 (JP) ..... JP2016-026731

(51) Int. Cl.
*C23F 17/00* (2006.01)
*C22C 23/00* (2006.01)
(Continued)

(52) U.S. Cl.
CPC ..... *C23F 17/00* (2013.01); *C22C 1/08* (2013.01); *C22C 3/00* (2013.01); *C22C 5/06* (2013.01);
(Continued)

(58) Field of Classification Search
CPC .... C23F 17/00; C23F 1/02; C23F 1/22; C23F 1/00; C22C 3/00; C22C 19/05;
(Continued)

(56) References Cited

U.S. PATENT DOCUMENTS 3,408,230 A * 10/1968 Dickinson ..... H01M 4/02 216/87
4,518,457 A * 5/1985 Gray ..... C25B 11/091 148/527
(Continued)

FOREIGN PATENT DOCUMENTS

CN 103406128 A 11/2013
CN 104 946 921 A 9/2015
(Continued)

OTHER PUBLICATIONS

Tsai et al., "Interfacial reaction and the dominant diffusing species in Mg—Ni system," J. Alloys and Compounds, 471 (2009) pp. 90-92 (Year: 2009).*
(Continued)

*Primary Examiner* — John A Hevey
(74) *Attorney, Agent, or Firm* — Oliff PLC

(57) ABSTRACT

A method for producing a porous member, whereby a member having smaller microgaps can be produced, and additionally, the outermost surface alone can be made porous and a porous layer can be formed on the surface while maintaining the characteristics of portions in which no porous layer is formed, is provided.

10 Claims, 10 Drawing Sheets

(51) Int. Cl.

| | |
|---|---|
| ***C22F 1/06*** | (2006.01) |
| ***C22F 1/10*** | (2006.01) |
| ***C22C 9/00*** | (2006.01) |
| ***C22F 1/08*** | (2006.01) |
| ***C23F 1/00*** | (2006.01) |
| ***C22F 1/00*** | (2006.01) |
| ***C23C 10/28*** | (2006.01) |
| ***C22C 1/08*** | (2006.01) |
| ***C22F 1/16*** | (2006.01) |
| ***C22C 19/05*** | (2006.01) |
| ***C22C 38/40*** | (2006.01) |
| ***C23C 10/00*** | (2006.01) |
| ***C22C 3/00*** | (2006.01) |
| ***C23C 10/06*** | (2006.01) |
| ***C22C 5/06*** | (2006.01) |
| ***C23F 1/02*** | (2006.01) |
| ***C23C 10/52*** | (2006.01) |
| ***C23C 10/58*** | (2006.01) |
| *C22C 29/02* | (2006.01) |

(52) U.S. Cl.

CPC ..... *C22C 9/00* (2013.01); *C22C 19/05* (2013.01); *C22C 19/056* (2013.01); *C22C 19/058* (2013.01); *C22C 23/00* (2013.01); *C22C 38/40* (2013.01); *C22F 1/00* (2013.01); *C22F 1/06* (2013.01); *C22F 1/08* (2013.01); *C22F 1/10* (2013.01); *C22F 1/16* (2013.01); *C23C 10/00* (2013.01); *C23C 10/06* (2013.01); *C23C 10/28* (2013.01); *C23F 1/00* (2013.01); *C23F 1/02* (2013.01); *B22F 2999/00* (2013.01); *C22C 29/02* (2013.01); *C23C 10/52* (2013.01); *C23C 10/58* (2013.01)

(58) Field of Classification Search

CPC ..... C22C 5/06; C22C 19/058; C22C 23/00; C22C 29/02; C22C 19/03; C22C 22/00; C22C 9/00; C22C 1/08; C22C 19/056; C22C 38/40; C23C 10/00; C23C 10/06; C23C 10/52; C23C 10/58; C23C 10/28; C22F 1/06; C22F 1/10; C22F 1/08; C22F 1/00; C22F 1/16; B22F 2999/00

See application file for complete search history.

(56) References Cited

U.S. PATENT DOCUMENTS

| | | | |
|---|---|---|---|
| 2017/0225955 | A1 | 8/2017 | Kato et al. |
| 2018/0114615 | A1 | 4/2018 | Zhang et al. |

FOREIGN PATENT DOCUMENTS

| | | | | |
|---|---|---|---|---|
| JP | 53014114 | A | * | 2/1978 |
| JP | S53-014114 | A | | 2/1978 |
| JP | 2008-184671 | A | | 8/2008 |
| JP | 2009-107158 | A | | 5/2009 |
| JP | 2015-196178 | A | | 11/2015 |
| WO | 2011/092909 | A1 | | 8/2011 |
| WO | 2016/039268 | A1 | | 3/2016 |
| WO | 2016/180359 | A1 | | 11/2016 |

OTHER PUBLICATIONS

Feb. 14, 2019 Extended Search Report issued in European Patent Application No. 17752862.7.

Mar. 21, 2017 International Search Report issued in International Patent Application No. PCT/JP2017/001154.

Tsai et al.; "Interfacial reaction and the dominant diffusing species in Mg—Ni system;" Journal of Alloys and Compounds; vol. 471; pp. 90-92; 2009.

May 7, 2020 Office Action issued in Chinese Patent Application No. 201780006088.X.

* cited by examiner (a)

(b)

METHOD FOR PRODUCING POROUS MEMBER

BACKGROUND OF THE INVENTION

Field of the Invention

The present invention relates to a method for producing a porous member.

Description of the Related Art

Conventionally, the present inventors have developed, namely, a molten metal refining method as a method for producing a porous metal member. This method involves immersing a metal material comprising a compound, an alloy, or a nonequilibrium alloy that simultaneously contains a second component and a third component having a positive heat of mixing and a negative heat of mixing, respectively, relative to a first component and having a melting point higher than the solidifying point of a metal bath comprising the first component in a molten metal bath that is controlled to have a temperature lower than the lowest liquidus temperature over the range of compositional variation, in which the third component is decreased so that the metal material is mainly composed of the second component, thereby selectively eluting the third component in the molten metal bath and thus obtaining a metal member having microgaps (for example, see Patent Literature 1). According to the molten metal refining method, a porous body made of the metal material having nanometer-sized microgaps can be readily produced.

Note that it has been reported that when solid Ni and solid Mg are brought into contact with each other and heat treatment is performed to conduct an interfacial reaction between different solid metals, interdiffusion takes place between Ni and Mg, and then a compound comprising $Mg_2Ni$ is formed in the interface (for example, see Non-patent Literature 1).

CITATION LIST

Patent Literature

Patent Literature 1: International Publication WO2011/092909

Non Patent Literature

Non Patent Literature 1: M. Y. Tsai, M. H. Chou and C. R. Kao, "Interfacial reaction and the dominant diffusing species in Mg—Ni system", Journal of Alloys and Compounds, 5 Mar. 2009, 471, p. 90-92

SUMMARY OF THE INVENTION

Technical Problem

The molten metal refining method according to Patent Literature 1 involves immersing a metal material in a metal bath for selective elution of a third component, which is characterized by rapid elution. However, the method is problematic in that such rapid elution results in coarse shapes of the thus formed microgaps, and increases the sizes of the microgaps to some extent. The method is also problematic in that a porous layer(s) is also formed in the deep portion of the member, even when only the surface of the member should be made porous. Furthermore, the method is also problematic in that when a porous layer is formed on the surface of a material where phase transformation and crystal grain coarsening take place at the temperature of a metal bath, the characteristics of a portion where no porous layer is formed are deteriorated.

The present invention has been achieved noting such problems. An objective of the present invention is to provide a method for producing a porous member, whereby a member having smaller microgaps can be produced, and additionally, only the outermost surface can be made porous and a porous layer can be formed on the surface while maintaining the characteristics of a portion where no porous layer is formed.

Solution to Problem

To achieve the above objective, the method for producing a porous member according to the present invention comprises bringing a solid metal body comprising a first component into contact with a solid metal material comprising a compound, an alloy or a non-equilibrium alloy that simultaneously contains a second component and a third component having a positive heat of mixing and a negative heat of mixing, respectively, relative to the first component, performing heat treatment at a predetermined temperature for a predetermined length of time, so as to diffuse the first component to the metal material side and diffuse the third component to the metal body side, selectively removing (dealloying) portions other than those mainly composed of the second component from the portions where the first component and/or the third component is diffused, and thus obtaining a member having microgaps.

The method for producing a porous member according to the present invention is based on a metallurgic technique focusing on the properties whereby when a solid metal body is brought into contact with a solid metal material comprising a compound, an alloy or a non-equilibrium alloy, and then heat treatment is performed, interdiffusion takes place so that a third component is diffused from the metal material into the metal body and a first component is diffused from the metal body into the metal material depending on the heat of mixing relative to the first component of the metal body. In the interdiffusion process, the second component has a positive heat of mixing relative to the first component, and thus is not diffused to the metal body side. Accordingly, a co-continuous composite is obtained, in which portions comprising the first component and the third component and portions mainly composed of the second component are intertwined with each other in nanometer order in the metal material. Through selective removal of portions other than those mainly composed of the second component under such a condition, a porous member which is mainly composed of the second component and has nanometer-sized microgaps can be produced. In addition, upon selective removal of portions other than those mainly composed of the second component, the portions mainly composed of the second component are preferably exposed.

Interdiffusion between solids slowly proceeds, compared to elution to a metal bath as described in Patent Literature 1, so that the method for producing a porous member according to the present invention creates a condition where portions comprising a first component and a third component and portions mainly composed of a second component are intertwined with each other more finely. Moreover, the method for producing a porous member according to the present invention can realize a smaller size of the thus formed microgaps compared to Patent Literature 1.

The method for producing a porous member according to the present invention varies the temperature and the length of time for heat treatment, so as to be able to changes the size of the microgaps of a member to be produced. Moreover, since the reaction proceeds from the surface of a metal material due to diffusion of the first component, and heat treatment is stopped in the middle thereof, only the surface of the metal material can be reformed, and a member having microgaps only on the surface can be produced. Unlike the technique of Patent Literature 1, regions to be reformed can be limited to portions on the outermost surface of the member. Furthermore, the temperature for heat treatment can be lower than that in Patent Literature 1, so as to be able to prevent phase transformation from taking place in portions where no porous metal is formed and deteriorated characteristics due to crystal grain growth, and to form a porous layer on the surface while maintaining the characteristics of the portions where no porous layer is formed. Furthermore, a metal material is shaped into any form such as a thin film and a hollow shape, and thus a member in an arbitrary shape having microgaps on the surface or throughout the member can also be produced. A member having microgaps can also be produced by performing vapor deposition of a first component on the surface of a metal material, and then performing heat treatment.

In the method for producing a porous member according to the present invention, a first component, a second component, and a third component may be single-type pure elements or multiple-type elements, respectively. Note that in the present invention, examples of metal components include metalloid elements such as carbon, silicon, boron, germanium, and antimony. Furthermore, the term "heat of mixing" refers to calories (negative heat of mixing) generated or calories (positive heat of mixing) absorbed when 2 or more types of substances are mixed at a constant temperature.

According to the method for producing a porous member according to the present invention, when the melting point of the first component on the basis of the absolute temperature is a half or higher than the melting point of the second component on the basis of the absolute temperature, the first component and the second component may be used in an opposite order. In this case, a co-continuous composite is obtained, in which portions comprising the second component and the third component and portions mainly composed of the first component are intertwined with each other in nanometer order in the metal material. Under such a condition, through selective removal of portions other than those mainly composed of the first component, a porous member mainly composed of the first component and having nanometer-sized microgaps can be produced.

In the method for producing a porous member according to the present invention, the heat treatment is preferably performed such that after the metal body is brought into contact with the metal material, the first component and the third component are interdiffused for binding with each other. Furthermore, after the heat treatment, a compound, an alloy or a non-equilibrium alloy formed by binding of the first component with the third component is preferably removed selectively. In addition, when interdiffusion regions are not formed throughout the metal body and the metal material, unreacted portions may be removed or left unremoved.

In the method for producing a porous member according to the present invention, after heat treatment, portions mainly composed of the second component may be exposed from the interdiffusion regions by any method. For example, portions containing the first component and the third component may be selectively eluted and removed by etching using an etching solution, an aqueous nitric acid solution, or the like.

In the method for producing a porous member according to the present invention, the temperature of the heat treatment is preferably maintained at a temperature that is 50% or more of the melting point of the metal body on the basis of the absolute temperature. This case can ensure the easy production of a member having even smaller microgaps.

In the method for producing a porous member according to the present invention, for acceleration of interdiffusion, during heat treatment, the solid metal body and the solid metal material are preferably brought into close contact with each other via their polished faces. In particular, the contact face of the metal body, which is to be in contact with the metal material, and the contact face of the metal material, which is to be in contact with the metal body, are subjected in advance to mirror finishing, and then during the heat treatment, the polished contact face of the metal body and the polished contact face of the metal material are preferably brought into close contact with each other.

In the method for producing a porous member according to the present invention, the first component preferably comprises Li, Mg, Ca, Cu, Zn, Ag, Pb, Bi, a rare earth metal element, or a mixture that is an alloy or a compound containing any one of them as a major component, the second component preferably comprises any one of Ti, Zr, Hf, Nb, Ta, V, Cr, Mo, W, Fe, Co, Ni, C, Si, Ge, Sn, and Al, or a mixture that is an alloy or a compound containing a plurality of them, and the third component preferably comprises any one of Li, Mg, Ca, Mn, Fe, Co, Ni, Cu, Ti, Zr, Hf, Nb, Ta, Cr, Mo, and W, or a mixture containing a plurality of them.

Furthermore, in the method for producing a porous member according to the present invention, the first component may comprise Mg, the third component may comprise Ni, and the metal material may comprise a Ni-containing alloy. In this case, a nickel-free member having microgaps can be readily produced. Here, the term "nickel-free" means that the concentration of nickel in atom % in a material is 1.0% or less.

Effect of the Invention

According to the present invention, a method for producing a porous member can be provided, whereby a member having smaller microgaps can be produced, and additionally, the outermost surface alone can be made porous and a porous layer can be formed on the surface while maintaining the characteristics of portions where no porous layer is formed.

DETAILED DESCRIPTION OF THE PREFERRED EMBODIMENTS

Hereafter, embodiments of the present invention are described below based on drawings with reference to examples.

Figure 1:
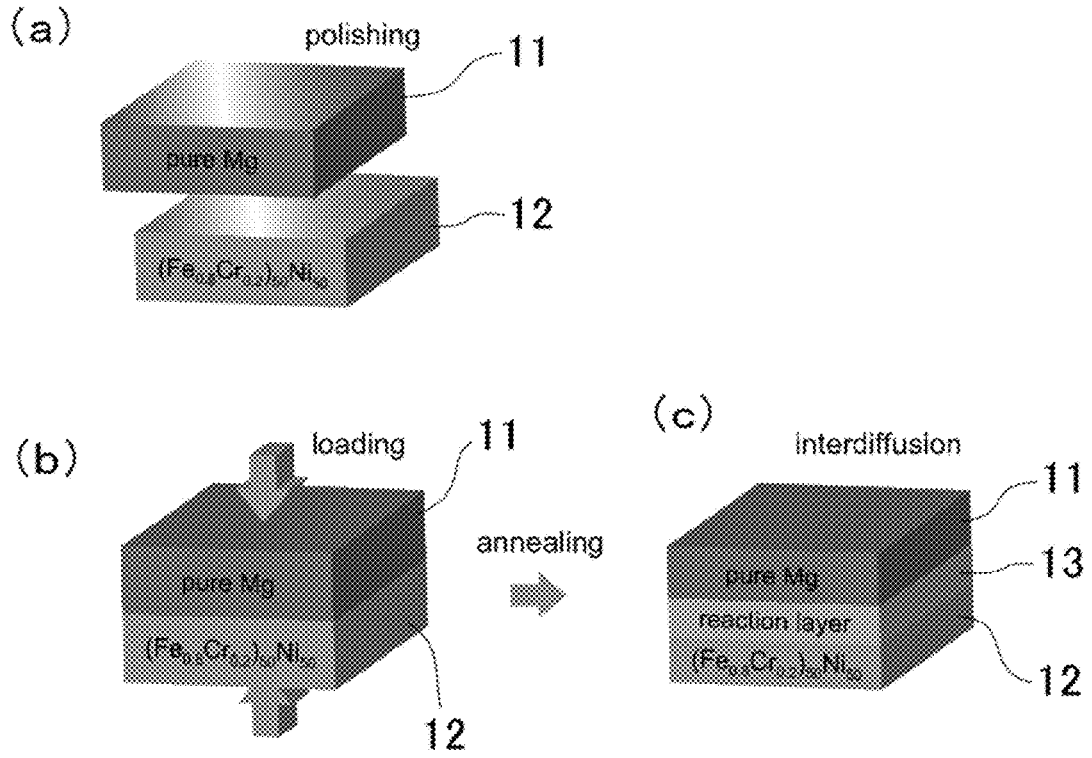
FIG. 1 is a schematic perspective view showing the method for producing a porous member of an embodiment of the present invention.

According to the method for producing a porous member of an embodiment of the present invention, firstly, as shown in FIG. 1(*a*), a solid metal body 11 comprising a first component and a solid metal material 12 comprising a compound, an alloy or a non-equilibrium alloy that simultaneously contains a second component and a third component having a positive heat of mixing and a negative heat of mixing, respectively, relative to the first component are used and brought into contact with each other.

In a specific example shown in FIG. 1, pure magnesium (pure Mg) is used as the metal body 11, and $(Fe_{0.8}Cr_{0.2})_{50}Ni_{50}$ alloy is used as the metal material 12. At this time, the first component is Mg, the second component is $Fe_{0.8}Cr_{0.2}$, and the third component is Ni. Moreover, the contact face of the metal body 11 and the contact face of the metal material 12 are each polished flat in advance for mirror finishing, and thus are brought into close contact via the contact faces. For mirror finishing, an ion peeling process or the like can be employed.

[Heat Treatment]

Next, as shown in FIG. 1(*b*), a load is applied (loading) to the interface between the metal body 11 and the metal material 12 so as to prevent separation thereof during treatment, and then annealing is performed as heat treatment. Heat treatment is performed by maintaining the temperature corresponding to 75% to 85% of the melting point of the metal body 11 on the basis of the absolute temperature for 5 or more and 80 or less hours. Accordingly, depending on the heat of mixing relative to the first component that is the metal body 11, interdiffusion takes place so that the third component is diffused from the metal material 12 into the metal body 11, and the first component is diffused from the metal body 11 into the metal material 12. The second component of the metal material 12 has positive heat of mixing relative to the first component, so that the second component is not diffused to the metal body 11 side. Therefore, as shown in FIG. 1(*c*), in the metal material 12, a region is obtained as a reaction region (reaction layer) 13, in which portions comprising the first component and the third component and portions comprising the second component are mixed with each other in nanometer order. At this time, interdiffusion between solids slowly proceeds compared to the elution to a metal bath as described in Patent Literature 1, resulting in a condition where portions comprising the first component and the third component and portions comprising the second component are more finely mixed with each other.

In a specific example shown in FIG. 1, the melting point of the metal body 11, Mg, is 650° C. (923K). Hence, when heat treatment is performed at about 420° C. to 510° C., interdiffusion takes place so that Ni is diffused from the metal material 12 into the metal body 11, and metal body 11, Mg, is diffused into the metal material 12. The metal material 12, $Fe_{0.8}Cr_{0.2}$, is not diffused to the metal body 11 side. In this manner, a reaction layer 13, in which $Mg_2Ni$ comprising Mg and Ni, and portions comprising $Fe_{0.8}Cr_{0.2}$ are mixed with each other in nanometer order in the metal material 12, can be obtained.

Figure 2:
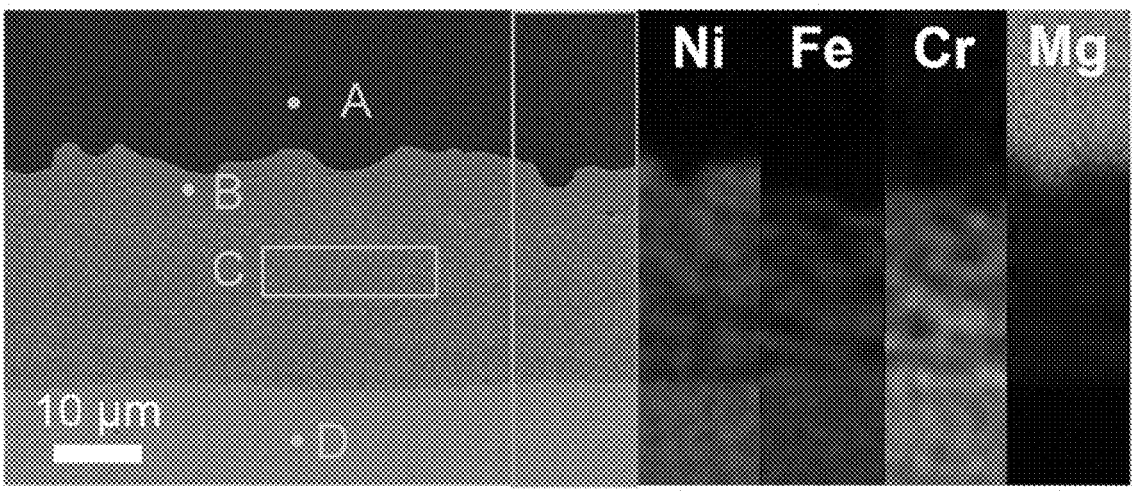
FIG. 2 shows a scanning electron micrograph of a metal body and a metal material after heat treatment, when the heat treatment of the method for producing a porous member of an embodiment of the present invention was performed at 460° C. for 12 hours, and the results of analyzing each element (Ni, Fe, Cr, and Mg) in a rectangular region by EDX.

FIG. 2 shows a scanning electron micrograph (SEM) when heat treatment was actually performed at 460° C. for 12 hours, and the results of analyzing each element (Ni, Fe, Cr, and Mg) by EDX (energy dispersive X-ray spectrometry). Furthermore, the results of performing composition analysis at positions A to D in FIG. 2 using a transmission electron microscope (TEM) are shown in Table 1. In addition, at the right end of Table 1, the chemical compositions of substances inferred on the basis of the composition analysis are indicated. In FIG. 2, positions A and B are located within a region of the metal body 11 before heat treatment, and positions C and D are located within a region of the metal material 12 before heat treatment.

TABLE 1

| | Ni | Fe | Cr | Mg | |
|---|---|---|---|---|---|
| A | ND | ND | ND | 100 | pure Mg |
| B | 32.1 | 0.6 | ND | 67.3 | $Mg_2Ni$ |
| C | 28.1 | 11.0 | 2.7 | 58.3 | $Fe_{0.8}Cr_{0.2}$ + $Mg_2Ni$ |
| D | 50.0 | 40.7 | 9.3 | ND | $Ni_{50}(Fe_{0.8}Cr_{0.2})_{50}$ |

As shown in FIG. 2 and Table 1, it was confirmed that only Mg was present at position A in the metal body 11 distant from the contact face for contact with the metal material 12, and the composition was not changed by heat treatment. It was also confirmed that $Mg_2Ni$ was present at position B in the metal body 11 near the contact face for contact with the metal material 12, and Ni was diffused from the metal material 12 into the metal body 11 by heat treatment, so as to bind with Mg. Furthermore, it was confirmed that $Fe_{0.8}Cr_{0.2}$ and $Mg_2Ni$ were present at position C in the metal material 12 near the contact face for contact with the metal body 11, and Mg was diffused from the metal body 11 into the metal material 12 by heat treatment, so as to bind with Ni. It was also confirmed that, Mg was not detected, but $(Fe_{0.8}Cr_{0.2})_{50}Ni_{50}$ was present at position D in the metal material 12 distant from the contact face for contact with the metal body 11, and the composition was not changed by heat treatment. As described above, it was confirmed that heat treatment caused interdiffusion to take place, whereby Ni was diffused from the metal material 12 into the metal body 11, and Mg of the metal body 11 was diffused into the metal material 12, and thus Mg and Ni were bound in the diffusion regions to form $Mg_2Ni$.

Figure 3:
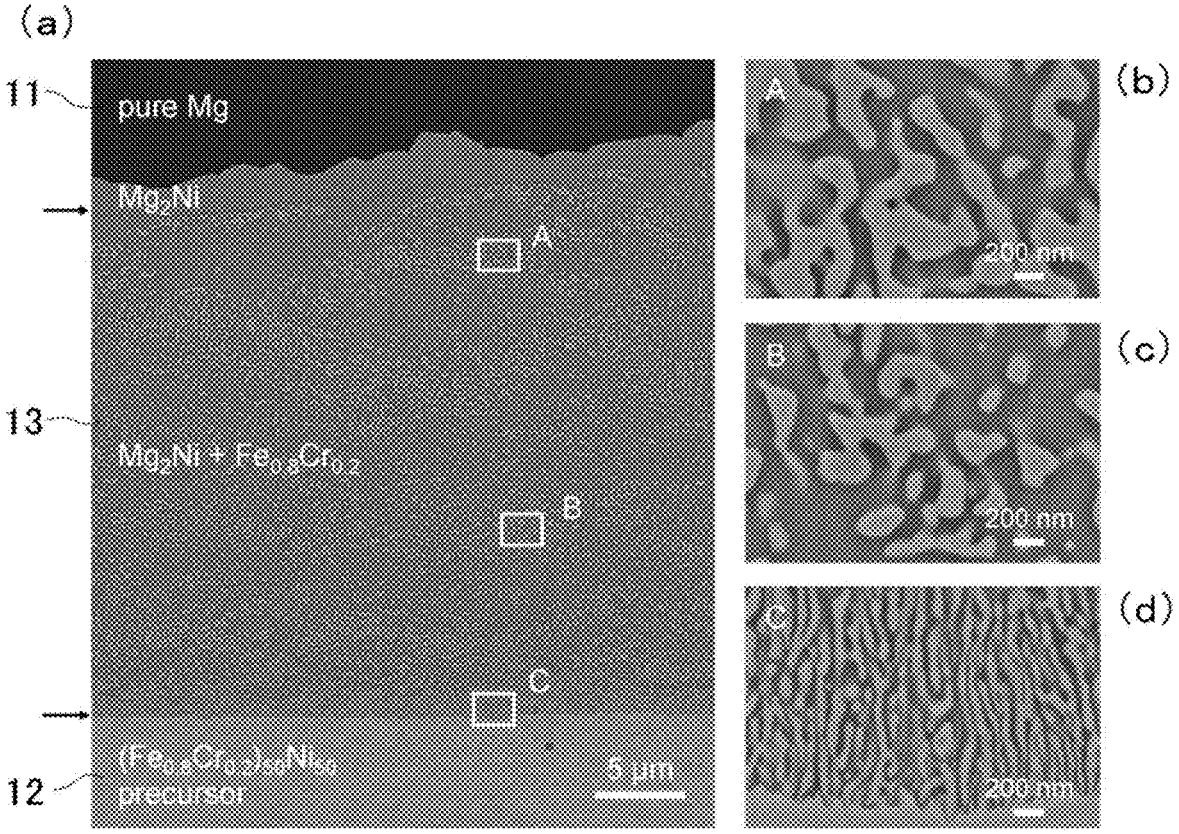
FIG. 3 shows (a) a scanning electron micrograph of a metal body and a metal material after heat treatment, (b) an enlarged micrograph of (a) at position A, (c) an enlarged micrograph of (a) at position B, and (d) an enlarged micrograph of (a) at position C, when the heat treatment of the method for producing a porous member of an embodiment of the present invention was performed at 460° C. for 12 hours.

A scanning electron micrograph when heat treatment was similarly performed at 460° C. for 12 hours is shown in FIG. 3(*a*). In addition, enlarged micrographs at each position (A to C) in FIG. 3(*a*) are shown in FIG. 3(*b*) to (*d*). Positions A to C are located in the reaction layer 13 (the region between a pair of arrows on the left edge of FIG. 3(*a*)) in which the first component, Mg, was diffused, among the regions of the metal material 12 before heat treatment. Position B is located in the neighborhood of the center of the reaction layer 13. Position A is located near the contact face for contact with the metal body 11, the location of which is closer to the contact face than that of Position B. Position C is located in the neighborhood of the dealloying front where Mg is diffused; that is, Position C is located in the neighborhood of the boundary between the reaction layer 13 and regions in which the metal material 12 remains unchanged.

As shown in FIG. 3(*b*) to (*d*), it was confirmed within the reaction layer 13 that $Mg_2Ni$ (bright portions in the Figure) and $Fe_{0.8}Cr_{0.2}$ (dark portions in the Figure) were mixed with each other in nanometer order of several hundred nanometers (nm) or less. In particular, it was confirmed in the neighborhood of the dealloying front where the first component, Mg, was diffused that, as shown in FIG. 3(*d*), $Mg_2Ni$ and $Fe_{0.8}Cr_{0.2}$ in filamentous forms were mixed with each other in nanometer order of 100 nm or less.

Figure 4:
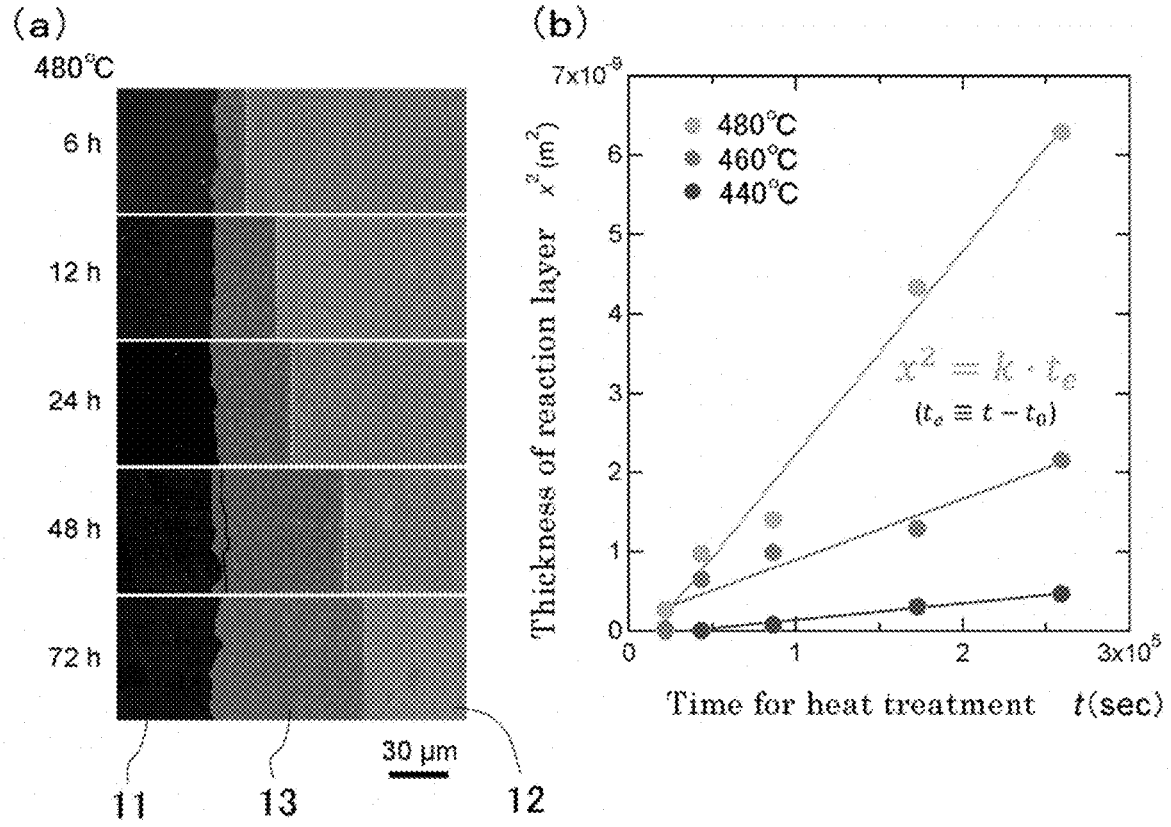
FIG. 4 shows: a scanning electron micrograph of a metal body and a metal material when (a) the heat treatment of the method for producing a porous member of an embodiment of the present invention was performed at 480° C. for each time length of heat treatment (6 hours, 12 hours, 24 hours, 48 hours, and 72 hours); and (b) a graph showing the relationship between the time for heat treatment and the thickness of the reaction region, when the heat treatment of the same was performed at 440° C., 460° C., and 480° C.

The relationship between the time for heat treatment and the thickness of the reaction layer 13 was examined when heat treatment was performed at 440° C., 460° C., and 480° C., and then shown in FIG. 4. As shown in FIG. 4(*a*), a situation in which the reaction layer 13 was increased as the time for heat treatment passed can be confirmed. Furthermore, as shown in FIG. 4(*b*), the presence of a relationship represented by $x^2=k\cdot(t-t_0)$ between the thickness "x" of the reaction layer 13 and the time "t" for heat treatment was confirmed. Here, "k" indicates the rate constant, and "$t_0$" indicates the latent time taken for the reaction to start. Moreover, it was confirmed that as the temperature of heat treatment increased, the enlarging rate of the reaction layer 13 increased.

Figure 5:
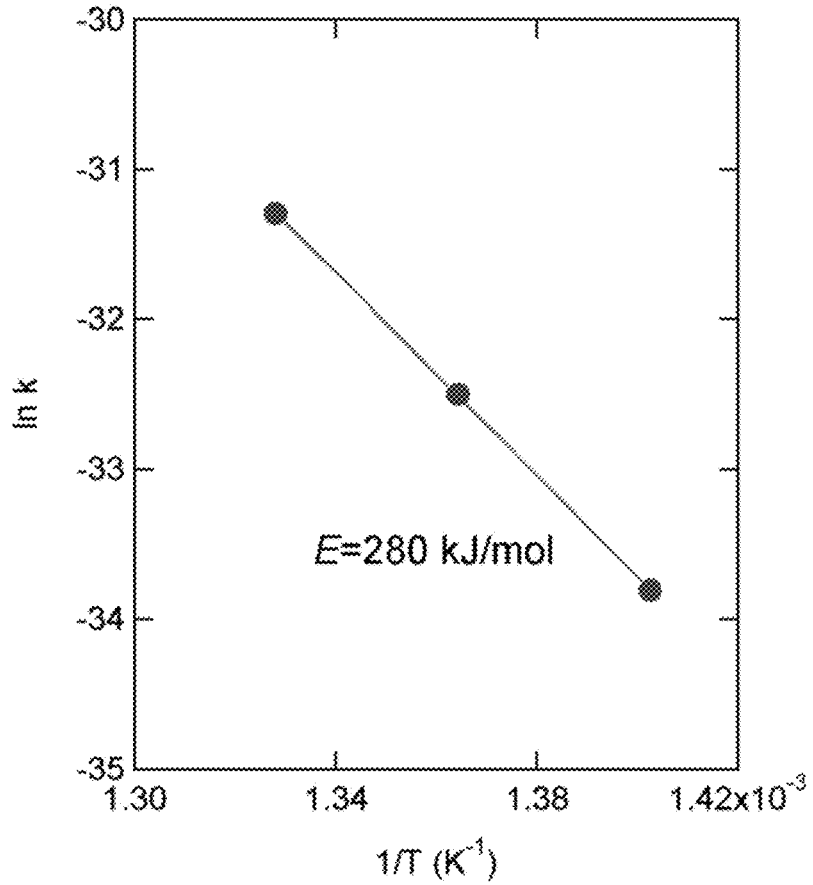
FIG. 5 is an Arrhenius plot of the rate constant k of the temperature of each heat treatment found in FIG. 4(*b*).

An Arrhenius plot obtained by plotting the rate constant "k" of each temperature of heat treatment found in FIG. 4(*b*) is shown in FIG. 5. The activation energy E of interdiffusion due to heat treatment, which was found from FIG. 5, was 280 kJ/mol.

[Etching Treatment]

Next, after heat treatment, portions other than portions mainly composed of the second component are removed by etching from the reaction layer 13, and specifically, the first component and the third component are selectively removed by elution, thereby exposing portions mainly composed of the second component. When the first component and the third component bind with each other to form a compound, an alloy or a non-equilibrium alloy, this is selectively removed. Accordingly, a porous member mainly composed of the second component and having nanometer-sized microgaps can be produced. At this time, interdiffusion between solids produces a condition where portions comprising the first component and the third component and portions comprising the second component are finely mixed with each other, so as to be able to realize the smaller size of microgaps to be formed, compared to Patent Literature 1.

In a specific example shown in FIG. 1, the metal material after heat treatment is immersed in an aqueous nitric acid solution, thereby removing $Mg_2Ni$ in the reaction layer 13. In this manner, a nanometer-sized member having microgaps mainly composed of $Fe_{0.8}Cr_{0.2}$ can be produced. Moreover, a nickel-free member having microgaps can be readily produced.

Figure 6:
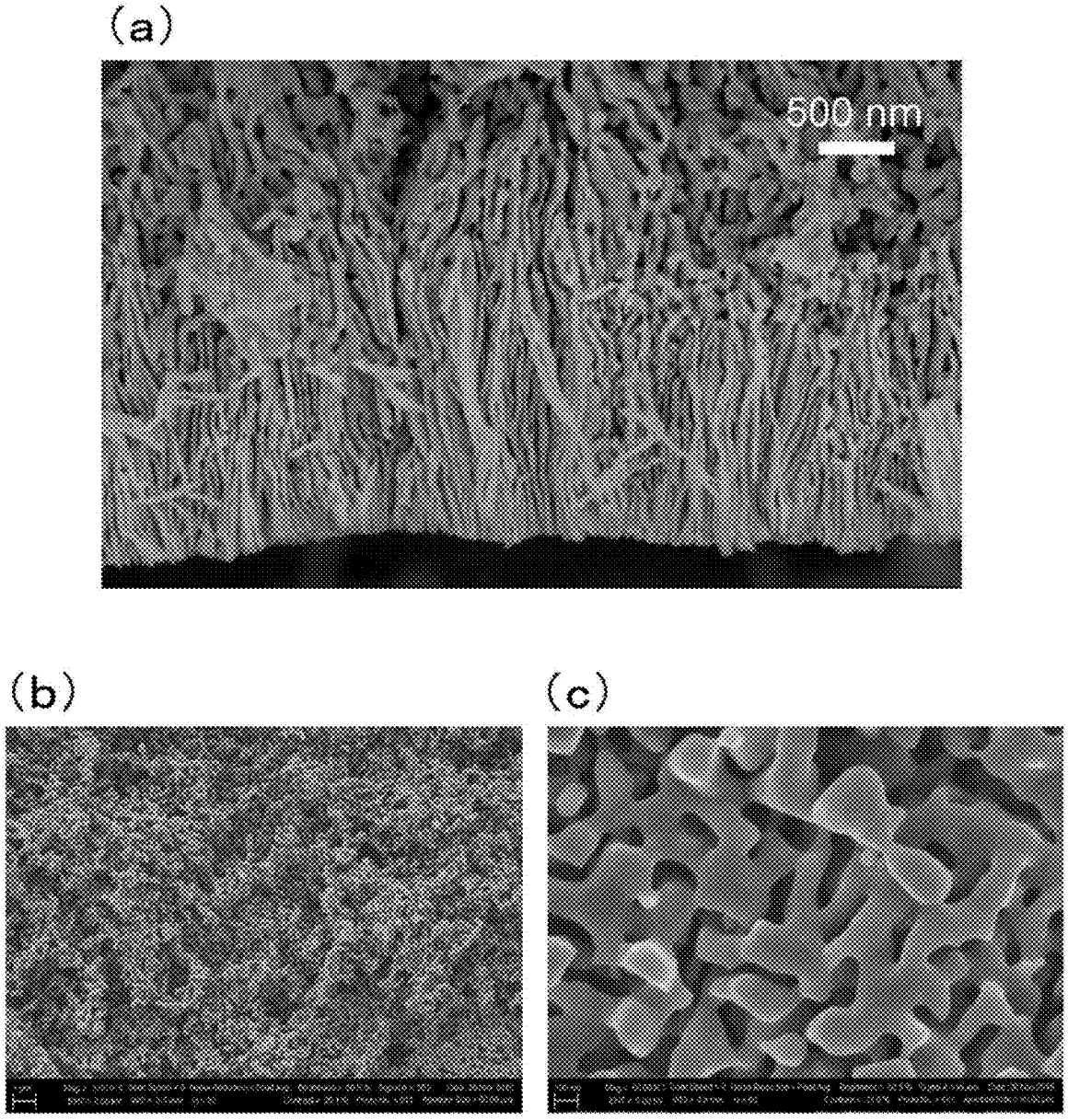
FIG. 6 shows (a) a scanning electron micrograph showing an area near the dealloying front of the reaction region, (b) a scanning electron micrograph showing the central part of the reaction region, and (c) an enlarged micrograph of a portion of (b), of a member produced by 12 hours of heat treatment at 460° C. and then performing etching according to the method for producing a porous member of an embodiment of the present invention.

Actually, after 12 hours of heat treatment at 460° C., the resultant was immersed in an aqueous nitric acid solution, subjected to etching, and then shown in FIG. 6. As shown in FIG. 6(*a*), in the neighborhood of the dealloying front of the reaction layer 13, a 100-nm-or-less, nanometer-order filamentary structure was confirmed. Moreover, as shown in FIGS. 6(*b*) and (*c*), a disordered nanoporous structure comprising a band structure having a width of 200 nm or less and having nanometer-order gaps was confirmed in the central part of the reaction region 13. It was confirmed by composition analysis using TEM that the structure was mainly composed of $Fe_{0.8}Cr_{0.2}$, from which most of Ni and Mg had been removed by etching. The gap size is about 1/10 the size of the metal member of Patent Literature 1.

Figure 7:
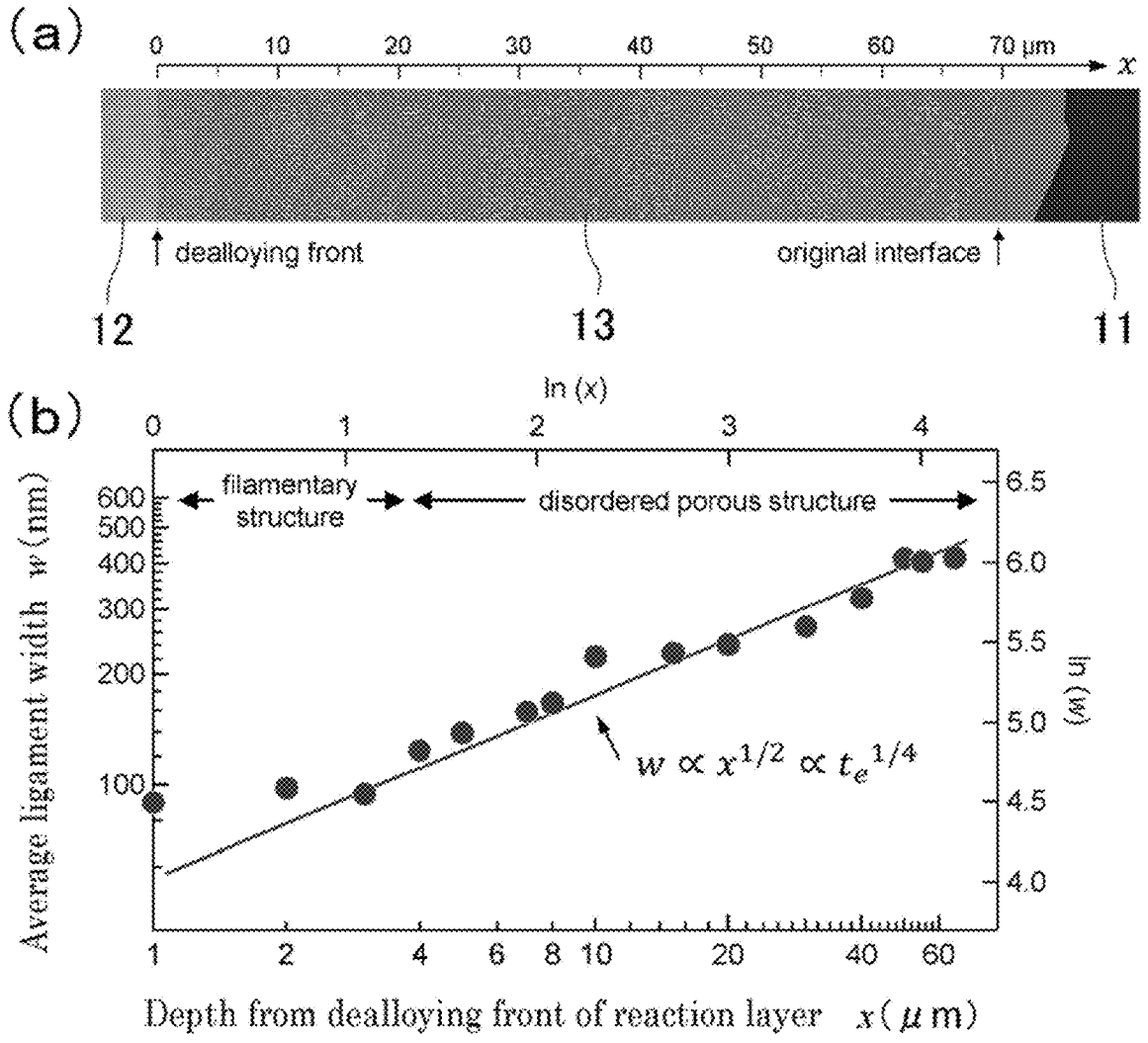
FIG. 7 shows (a) a scanning electron micrograph of, and (b) a graph showing the relationship between depth "x" from the dealloying front of the reaction region and the average ligament width "w" of a filamentary structure or a band structure in a member produced by 72 hours of heat treatment at 480° C. and then performing etching according to the method for producing a porous member of an embodiment of the present invention.

A member obtained by etching after 72 hours of heat treatment at 480° C. was examined for the relationship between the depth from dealloying front "x" of the reaction layer 13 and the average ligament width "w" of a filamentary structure or a band structure having microgaps and mainly composed of $Fe_{0.8}Cr_{0.2}$, and the results are shown in FIG. 7. As shown in FIG. 7, "w" was confirmed to decrease toward the dealloying front of the reaction layer 13, and to be almost proportional to "x" raised to the power of ½ (heat treatment time raised to the power of ¼). Accordingly, it can be said that the longer the time of being affected by diffusion, the larger the structure, and the larger the gaps.

Other Examples

A 30-micron thick $Ti_{50}Cu_{50}$ (atom %) amorphous ribbon (metal material 12) was pressed at 20 MPa against a mirror-polished Mg plate (metal body 11), the resultant was heated to 480° C., that is, the temperature corresponding to 50% or more of the melting point of Mg, and then maintained. Therefore, a co-continuous-structured nanocomposite formation comprising portions that contain Cu (third component) and Mg (first component) as major components and portions that contain Ti (second component) as a major component was formed in the contact interface of the two. The formation was immersed in nitric acid to remove portions other than those containing Ti as a major component, and thus a porous metal member having gaps with a size of 100 nm or less was obtained. Furthermore, a 1-micron thick $Mn_{85}C_{15}$ (atom %) alloy thin film (metal material 12) was deposited on a 30-micron thick Ag foil (metal body 11) by a magnetron sputtering technique. The thin film was subjected to heat treatment in an argon atmosphere at 800° C., Mn was diffused from the alloy thin film to the Ag foil side, so that a co-continuous-structured nanocomposite formation comprising portions containing Ag (first component) and Mn (third component) as major components and portions containing C (second component) as a major component was formed in the interface. This was immersed in nitric acid to remove portions other than those containing C as a major component, thereby obtaining a porous carbon member having gaps with a size of 100 nm or less.

Furthermore, a 1-micron thick $Mn_{85}C_{15}$ (atom %) alloy thin film (metal material 12) was deposited on the 30-micron thick Cu foil (metal body 11) by a magnetron sputtering technique. The thin film was subjected to heat treatment in an argon atmosphere at 800° C., Mn was diffused from the alloy thin film to the Cu foil side, and thus a co-continuous-structured nanocomposite formation comprising portions containing Cu (first component) and Mn (third component) as major components and portions containing C (second component) as a major component was formed in the interface. The formation was immersed in nitric acid to remove portions other than those containing C as a major component, thereby obtaining a porous carbon member having gaps with a size of 100 nm or less.

An $(Fe_{0.8}Cr_{0.2})_{50}Ni_{50}$ alloy (metal material 12) was pressed at 20 MPa to a 30-micron thick $Mg_{86}Ni_9Ca_5$ (atom %) metal glass ribbon (metal body 11), and then the temperature was increased to 140° C. or higher, which is the glass transition temperature of the metal glass ribbon. Therefore, the metal glass ribbon was transformed into a super cooled liquid, and then the viscous flow phenomenon caused the two to come into contact with no gaps regardless of their surface finishing state. Next, the resultant was heated to and maintained at 450° C., that is, the temperature corresponding to 50% or more of the melting point of the $Mg_{86}Ni_9Ca_5$ alloy. In this manner, a co-continuous-structured nanocomposite formation comprising portions containing Mg (first component) and Ni (third component) as major components and portions containing Fe and Cr (second component) as major components was formed in the contact interface between the two. The resultant was immersed in nitric acid to remove portions other than those containing Fe and Cr as major components, thereby obtaining a porous metal member having gaps with a size of 100 nm or less.

Using porous Cu having a specific surface area of 100 $m^2/g$ as a substrate (metal body 11), a $Mn_{85}C_{15}$ (atom %) alloy thin film (metal material 12) was uniformly deposited on the surface of nanoporous Cu by the CVD method. The resultant was subjected to heat treatment in an argon atmosphere at 800° C., Mn was diffused from the alloy thin film to the nanoporous Cu side, and thus a co-continuous-structured nanocomposite formation comprising portions containing Cu (first component) and Mn (third component) as major components and portions containing C (second component) as a major component was formed in the interface. The resultant was immersed in nitric acid to remove portions other than those containing C as a major component, so that a bimodal porous product composed of a macro structure that is the skeletal shape of porous Cu used as a substrate, and a micro structure that is nanoporous carbon. Accordingly, the surface area of C generated per gram of Cu could be increased to an area about 10 times the original surface area.

In addition, according to the method for producing a porous member of an embodiment of the present invention, a reaction proceeds from the surface of the metal material 12 due to diffusion of the first component, so that only the surface of the metal material 12 can be reformed by stopping heat treatment in the middle thereof, and a member having microgaps only on the surface can be produced. Furthermore, the metal material 12 is formed into any shape such as a thin film or a hollow shape, and thus a member formed in an arbitrary shape having microgaps on the surface or throughout the member can also be produced.

Figure 8:
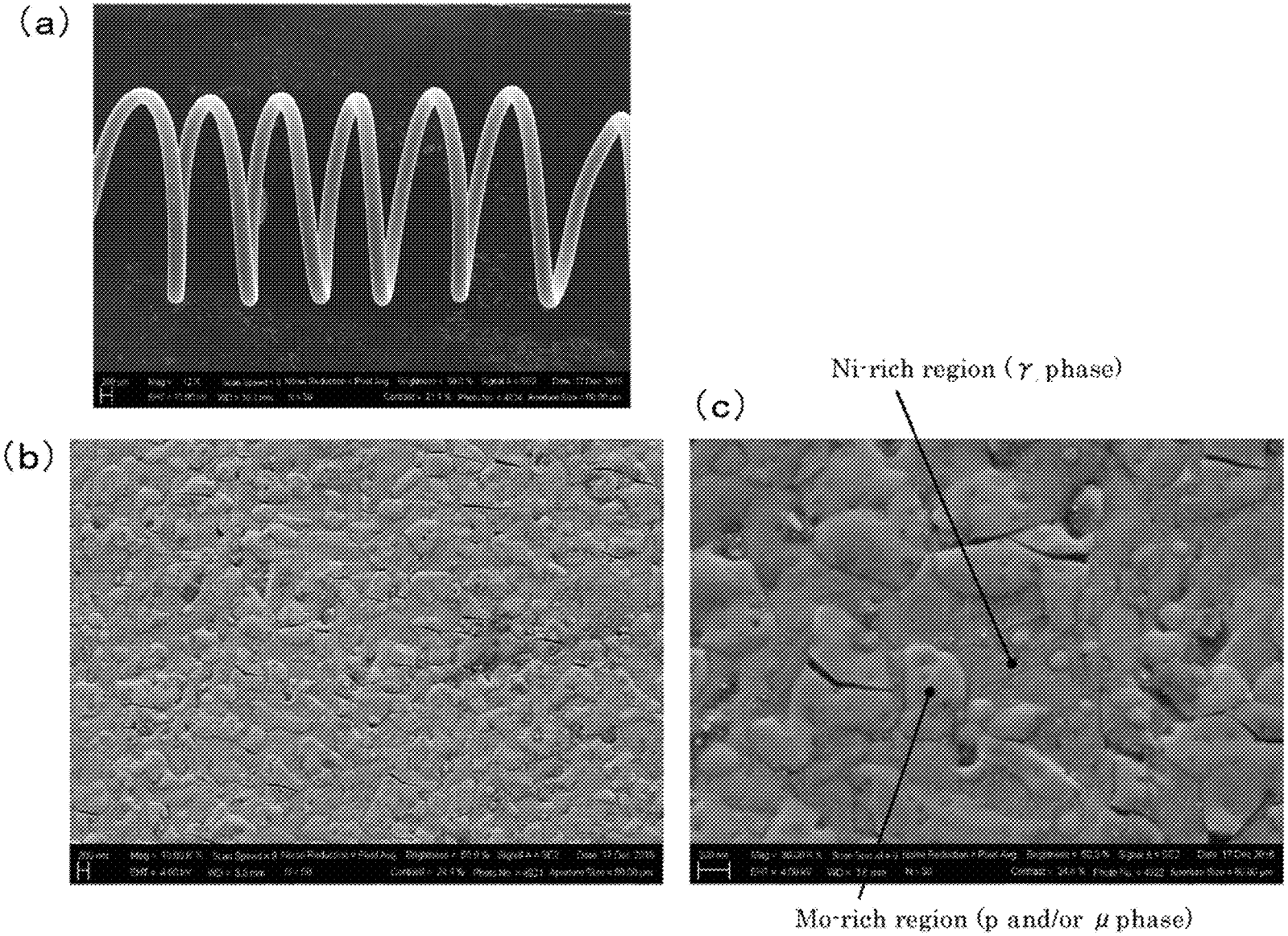
FIG. 8 shows (a) a scanning electron micrograph of a coil spring made of HASTELLOY C-276, the metal material used in the method for producing a porous member of an embodiment of the present invention, (b) an enlarged micrograph of the surface of the coil spring, and (c) an enlarged micrograph of a portion of (b).
Figure 9:
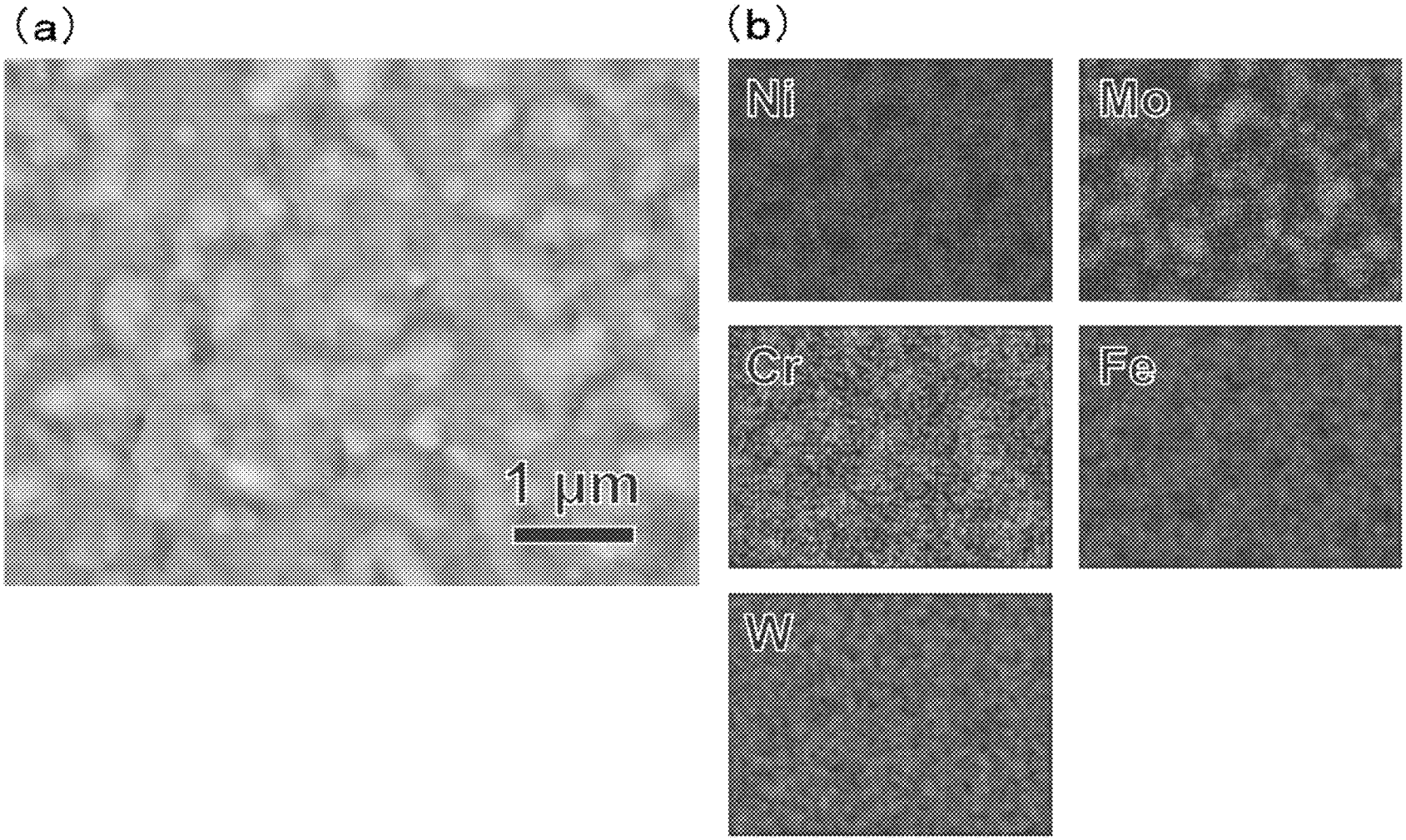
FIG. 9 shows (a) a scanning electron micrograph of the surface of the coil spring, the metal material shown in FIG. 8 and (b) the results of analyzing each element (Ni, Mo, Cr, Fe and W) in the (a) region by EDX.
Figure 10:
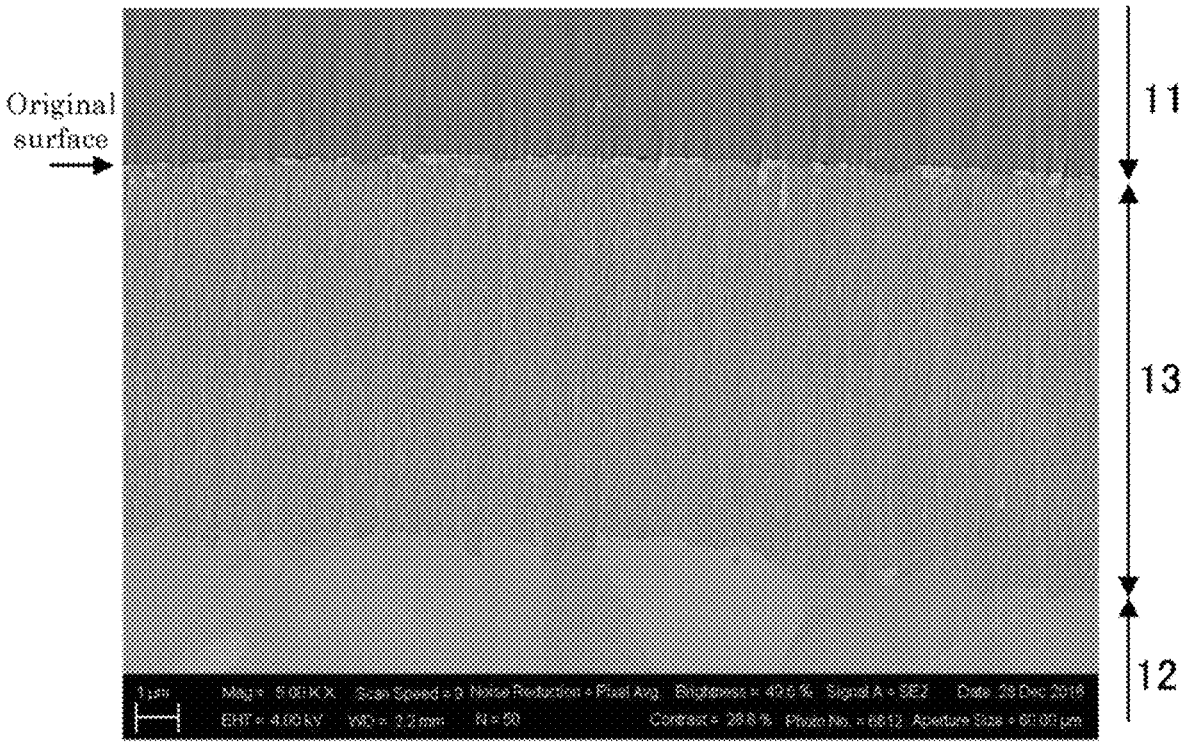
FIG. 10 shows a scanning electron micrograph of the cross section of the coil spring, when Mg was deposited by vacuum deposition on the surface of the coil spring, the metal material shown in FIG. 8, and then heat treatment was performed at 460° C. for 12 hours according to the method for producing a porous member of an embodiment of the present invention.

Mg (metal body 11; first component) was deposited by vacuum deposition on the surface of a coil spring (metal material 12) made of HASTELLOY C-276 ($Ni_{57}Cr_{16}Mo_{16}W_4Fe_5$ (wt %) alloy), and then heat treatment was performed for 12 hours in an Ar gas atmosphere at 460° C. at which all compounds in the coil spring and Mg can maintain the solid phase. Scanning electron micrographs (SEM) of the coil spring made of HASTELLOY C-276 before vacuum deposition, and the results of analyzing each element (Ni, Mo, Cr, Fe, and W) by EDX (energy dispersive X-ray spectrometry) are shown in FIG. 8 and FIG. 9, respectively. In addition, a scanning electron micrograph of the cross section of the coil spring after heat treatment is shown in FIG. 10.

As shown in FIG. 8 and FIG. 9, the coil spring made of HASTELLOY C-276 was confirmed to be a multiphasic alloy containing a p phase and a μ phase in which Mo (second component) was concentrated, and a γ phase in which Ni (third component) was concentrated. Further, as shown in FIG. 10, it was confirmed that reaction layer 13 was formed in the contact interface between a vapor-deposited Mg layer and the coil spring by heat treatment. Within the reaction layer 13, it was confirmed that the Ni component was selectively diffused (dealloyed) from the γ phase into Mg, and a co-continuous-structured nanocomposite formation was formed, in which portions (dark portions in the figure) containing Ni (third component) and Mg (first component) as major components, and portions (bright portions in the figure) in which Mo (second component) was concentrated because of depletion of Ni from the γ phase were mixed with each other in nanometer order.

Figure 11:
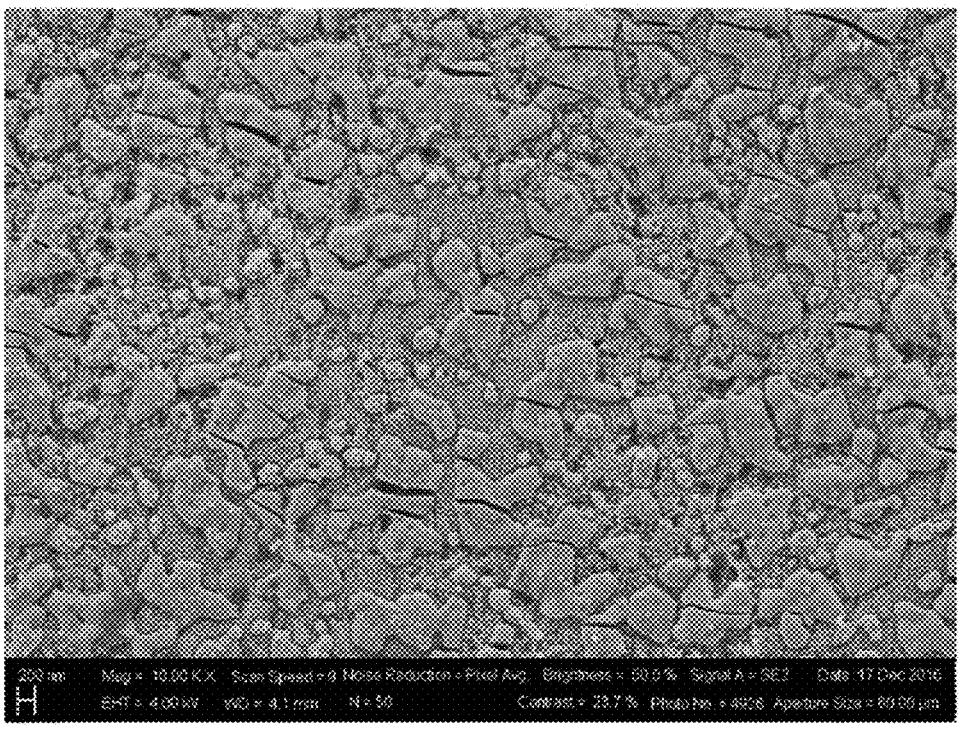
FIG. 11 shows (a) a scanning electron micrograph of the outermost surface of the coil spring, when etching was performed for the coil spring after heat treatment shown in FIG. 10 of the method for producing a porous member of an embodiment of the present invention, and (b) an enlarged micrograph of a portion of (a).
Figure 11:
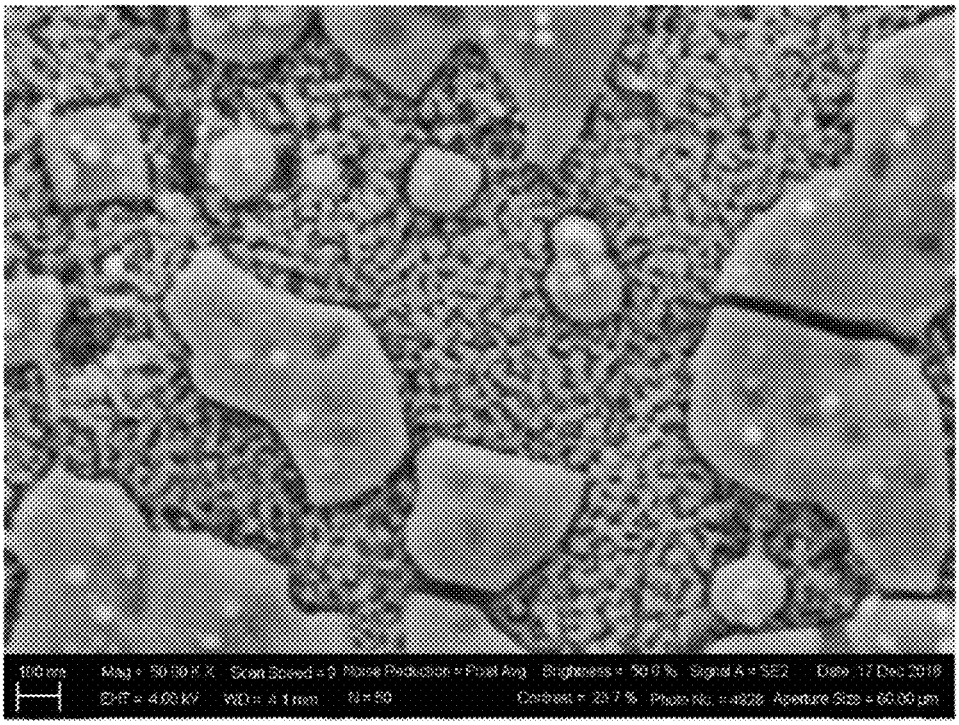

Heat treatment was performed and then the resultant was immersed in nitric acid, thereby performing etching to remove portions other than those containing Mo as a major component. Scanning electron micrographs of the outermost surface of the coil spring at this time are shown in FIG. 11. The p phase and the μ phase regions remained as fine grains on the outermost surface before heat treatment as shown in FIG. 8. However, as shown in FIG. 11, after heat treatment and after etching, only the portions containing Ni and Mg as major components were removed from the co-continuous nanocomposite formation formed in the original γ phase region. It was thus confirmed that a porous metal member having 10-nm-order gaps was obtained.

As described above, according to the method for producing a porous member of an embodiment of the present invention, the steam of the first component was sprayed over the surface of the metal material 12 for adhesion, followed by heat treatment, so that a member having microgaps can also be produced. In this case, even if the metal material 12 has a complicated shape, a porous member can be relatively readily produced. Therefore, for example, a stent or the like having microgaps that are formed only on the surface can be produced.

REFERENCE SIGNS LIST

11 Metal body
12 Metal material
13 Reaction layer

What is claimed is:

1. A method for producing a porous member, which comprises:

bringing a solid metal body (1) comprising a first component into contact with a solid metal material (2) comprising a compound, an alloy or a non-equilibrium alloy that simultaneously contains a second component and a third component having a positive heat of mixing and a negative heat of mixing, respectively, relative to the first component;

performing heat treatment at a predetermined temperature for a predetermined length of time to interdiffuse the first component to the solid metal material (2), and the third component to the solid metal body (1); and selectively removing the first component and the third component from a portion of the solid metal material (2) in which the first component is diffused, thereby obtaining a member having microgaps.

2. The method for producing a porous member according to claim 1, wherein the portion of the solid metal material (2) in which the first component is diffused is exposed when the first component and the third component is selectively removed.

3. The method for producing a porous member according to claim 1, wherein the heat treatment is performed after the contact of the solid metal body (1) with the solid metal material (2), so that the first component and the third component are interdiffused for binding with each other.

4. The method for producing a porous member according to claim 3, wherein after the heat treatment is performed, a compound, an alloy or a non-equilibrium alloy formed by binding of the first component with the third component is selectively removed.

5. The method for producing a porous member according to claim 1, wherein after the heat treatment is performed, the first component and the third component are selectively eluted and removed by etching.

6. The method for producing a porous member according to claim 1, wherein the heat treatment is performed by maintaining a temperature corresponding to 50% or more of the melting point of the solid metal body (1) on the basis of the absolute temperature.

7. The method for producing a porous member according to claim 1, wherein the contact face of the metal body (1) with the metal material (2) and the contact face of the solid metal material (2) with the solid metal body (1) are mirror-finished in advance, and during the heat treatment, the contact face of the solid metal body (1) and the contact face of the solid metal material (2) are brought into close contact with each other.

8. The method for producing a porous member according to claim 1, wherein the first component comprises Li, Mg, Ca, Cu, Zn, Ag, Pb, Bi, a rare earth metal element, or, a mixture that is an alloy or a compound containing any one of them as a major component, the second component comprises any one of Ti, Zr, Hf, Nb, Ta, V, Cr, Mo, W, Fe, Co, Ni, C, Si, Ge, Sn, and Al, or, a mixture that is an alloy or a compound containing a plurality thereof, and the third component comprises any one of Li, Mg, Ca, Mn, Fe, Co, Ni, Cu, Ti, Zr, Hf, Nb, Ta, Cr, Mo, and W, or a mixture containing a plurality thereof.

9. The method for producing a porous member according to claim 1, wherein the first component comprises Mg, the third component comprises Ni, and the solid metal material (2) comprises a Ni-containing alloy.

10. A method for producing a porous member, which comprises bringing a solid metal body (1) comprising a second component into contact with a solid metal material (2) comprising a compound, an alloy or a non-equilibrium alloy that simultaneously contains a first component and a third component, performing heat treatment at a predetermined temperature for a predetermined length of time so as to interdiffuse the second component to the solid metal material (2) and the third component to the solid metal body (1), and selectively removing the second component and the third component from a portion of the solid metal material (2) in which the second component is diffused, thereby obtaining a member having microgaps, wherein the second component and the third component have a positive heat of mixing and a negative heat of mixing, respectively, relative to the first component, and the melting point of the first component on the basis of the absolute temperature corresponds to at least a half of the melting point of the second component on the basis of the absolute temperature.

* * * * *